US005133497A

United States Patent [19]

Küppersbusch

[11] Patent Number: 5,133,497

[45] Date of Patent: Jul. 28, 1992

[54] CONTAINER

[75] Inventor: Gerd Küppersbusch, Velbert, Fed. Rep. of Germany

[73] Assignee: Dipl. - Physiker Lutz H. Prufer, Munich, Fed. Rep. of Germany

[21] Appl. No.: 699,511

[22] Filed: May 14, 1991

[30] Foreign Application Priority Data

May 23, 1990 [DE] Fed. Rep. of Germany ..... 4016655

[51] Int. Cl.[5] ..... B65D 43/02

[52] U.S. Cl. ..... 229/125.15; 229/137; 229/140; 222/183; 222/529; 222/530; 222/534

[58] Field of Search ..... 229/125.15, 125.28, 229/137, 138, 140; 222/105, 183, 527, 528, 529, 530, 533, 534, 535, 536, 538

[56] References Cited

U.S. PATENT DOCUMENTS

| | | | |
|---|---|---|---|
| 3,108,732 | 10/1963 | Curie et al. | 222/105 |
| 3,138,315 | 6/1964 | Morrow | 229/125.15 |
| 3,650,458 | 3/1972 | Rausing | 229/125.15 |
| 3,795,359 | 3/1974 | Rausing | 229/137 |
| 4,301,927 | 11/1981 | Carlsson et al. | 229/140 |
| 4,433,784 | 2/1984 | Kjelgaard | 229/137 |
| 4,754,917 | 7/1988 | Gordon et al. | 229/137 |
| 4,798,296 | 1/1989 | Lagerstedt et al. | 229/125.15 |
| 4,819,865 | 4/1989 | Lisiecki | 229/137 |
| 4,930,683 | 6/1990 | Färber | 229/125.15 |

FOREIGN PATENT DOCUMENTS

| | | |
|---|---|---|
| 0342729A1 | 11/1989 | European Pat. Off. . |
| 3441865A1 | 7/1985 | Fed. Rep. of Germany . |
| 3720240A1 | 12/1988 | Fed. Rep. of Germany . |

*Primary Examiner*—Stephen Marcus
*Assistant Examiner*—Christopher McDonald
*Attorney, Agent, or Firm*—Donald Brown

[57] ABSTRACT

In a container such as a cardboard container for packaging milk which comprises sidewalls, a bottom flap and a top flap as well as an ear to be folded down around a folding edge for forming a pouring spout the problem is encountered that, for opening the container, an outer portion of the ear has to be cut away and, after opening the container, no reclosure is possible, but the pouring spout remains open and may be a source of pollution.

In order to obviate this problem the ear of the inventive container comprises a socket member projecting from the ear at the surface thereof adjacent to the folding edge and facing a sidewall of the container, and there is an aperture provided in the facing sidewall for receiving the socket member. In this manner, the socket member forms a reclosable pouring spout of the container.

13 Claims, 3 Drawing Sheets

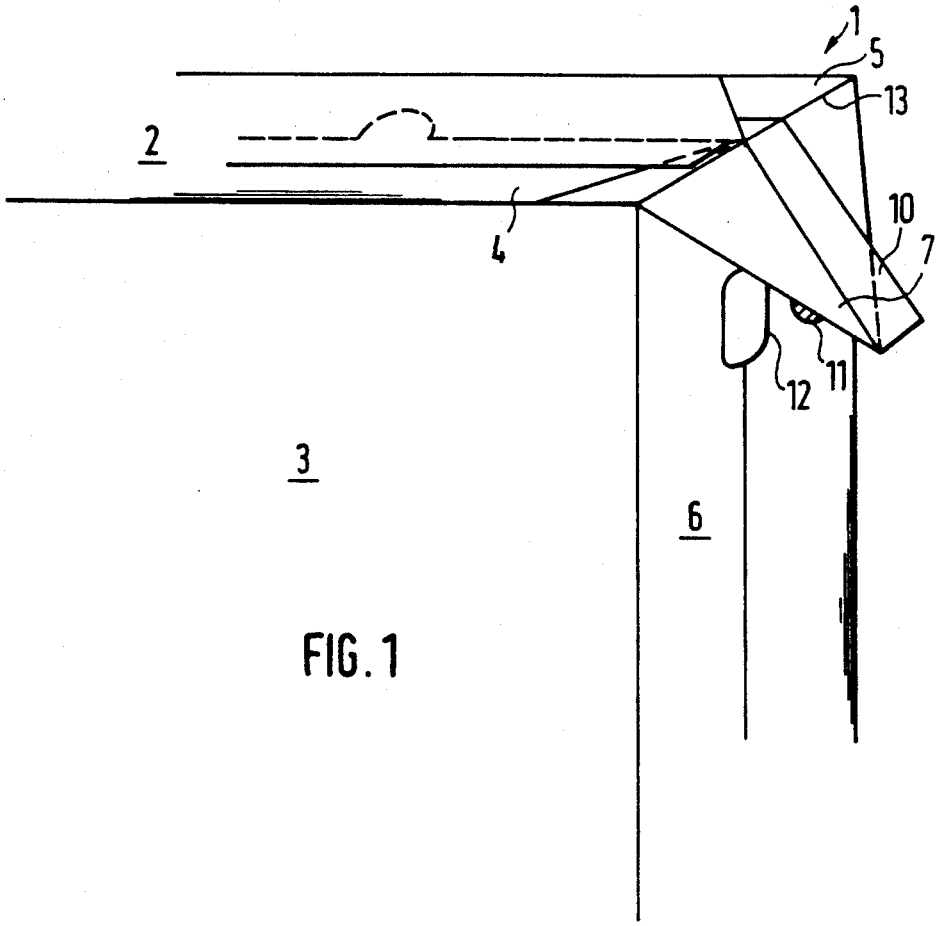
FIG. 1
FIG. 2
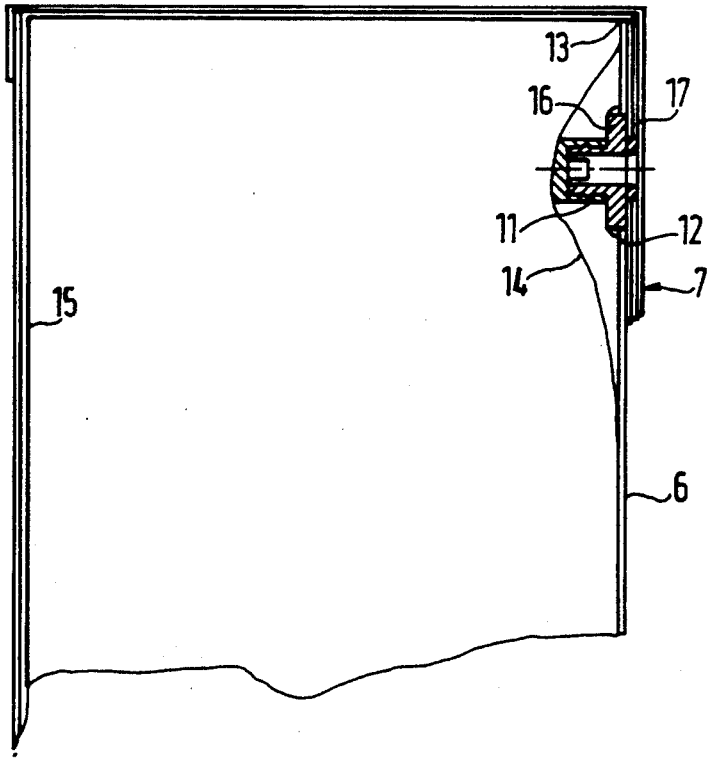

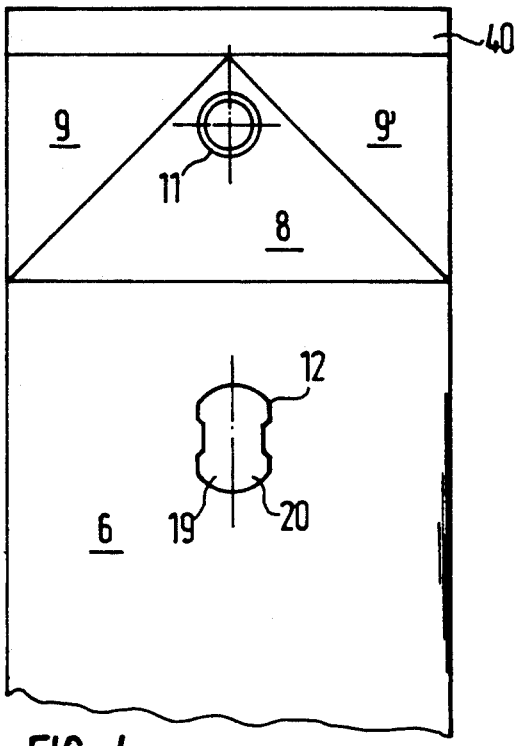
FIG. 4
FIG. 3
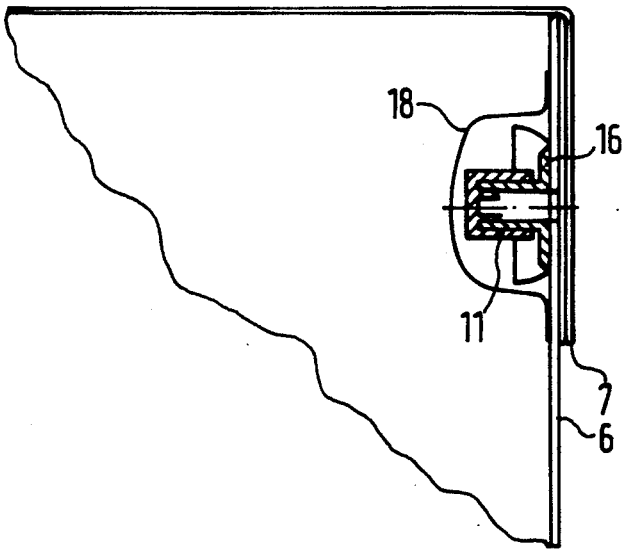

CONTAINER

BACKGROUND OF THE INVENTION

The invention relates to a container having sidewalls, bottom and top flaps and an ear folded down around a folding edge for forming a pouring spout. The surface of the ear when folded down abuts the container wall adjacent to the folding edge.

A container of this kind is disclosed in German Patent Application 37 20 240.

This container is used for packing and selling milk to consumers. If this known container is to be opened, the ear which had been glued to the lateral wall surface for distribution, is folded upwards and scissors are used for cutting away an outer portion of the ear such that the interior of the container may be accessed. Hence, this conventional container requires tools for opening the same and it can not again be reclosed; the closure region remains open which results in a danger of pollution.

The German Patent Application 34 41 865 discloses a container having one side with a salient member for forming a pouring spout and a closure nipple at the adjacent wall for receiving the salient member. The salient member is disposed at the surface of the container and the nipple is provided at a lid wall for sealing the salient member. The fact that the salient member for forming the pouring spout is disposed at the surface of the container makes it difficult to pour. If the container is opened, there is as well a danger of polluting the upwardly open closure region.

The European Patent Application 0 342 729 discloses closure members for cardboard beverage containers wherein a closure cap may be drawn over a salient member for closing the container. Again, the salient member is uncovered and may be polluted.

OBJECTS OF THE INVENTION

It is an object of the invention to provide an improved container in which the above-mentioned drawbacks are avoided.

It is a further object of the invention to provide a container having improved pouring characteristics.

It is a still further object of the invention to provide a container with a closure which may be opened without using tools.

It is a still further object of the invention to provide a reclosable container having a closure region with protection against pollution.

SUMMARY OF THE INVENTION

In order to achieve the above-mentioned objects, the invention provides a container comprising sidewalls, a bottom flap and a top flap, an ear to be folded down around a folding edge for forming a pouring spout, the surface of said ear, when folded down, abutting the container wall adjacent to said folding edge, a socket member projecting from said ear at the surface thereof adjacent to said folding edge for forming said pouring spout, and an aperture provided in said container wall for receiving said salient member.

It is an advantage of the inventive container that the ear which abuts the surface of the container during the transport may be lifted or folded upwards by using the fingers only and without the need for any tool. It provides no difficulties to design the socket member for reclosure in a manner to be easily operated by hand without using a tool. Since the ear is folded down and abuts the outer surface of the container when not in use, the socket member entering into the aperture within the container wall the socket member is protected against pollution. Furthermore, the socket member allows a controlled pouring operation and prevents the beverage or liquid to gush out of the container. Although the salient pouring member projects beyond the surface of the ear, the package can be formed such that the volume is most effectively used in that no projecting members are present during off-use of the container.

Preferred embodiments are defined in the dependent claims. It is the advantage of the embodiment of claim 2 that a leak-proof connection between the salient member and the surface of the ear may easily be formed. Claims 3 and 4 define preferred embodiments of the reclosable closure. It is the advantage of the embodiment of claim 5 that the container can be formed in a very stable and stiff manner. The container is very shock and pressure resistant.

Claim 6 defines a preferred embodiment for sealing the aperture from the interior of the container. According to claim 7 the filled container is supplied to the end user with the ear and the salient member being locked behind the edges of the elongate hole. Thus the ear does not project beyond the contour of the container. This is a particularly space-saving embodiment. After having lifted the ear and partly emptied the container, the user may fold back the ear and again lock the salient member within the aperture. The container according to claim 8 has a pleasant appearance in that the aperture is covered. Moreover, the aperture is protected by the flap or ear.

It is the advantage of the embodiment of claim 9 that the folded cardboard package and the loose interior foil bag can easily be separated from each other. The user is therefore provided with a container which is made absolutely leak-proof by the foil bag and therefore is suitable for use with liquids or powder. On the other hand, the folded cardboard package provides the rigidity required for storage, transport and use of the container. Moreover, the end user can recycle the cardboard parts of the container to paper recycling and the foil parts, normally a plastic foil, and the closure member to plastic recycling. The particular advantage of this container is therefore its extreme low harm to the environment.

The embodiment of claim 10 provides a particularly easy possibility for producing an absolutely leak-proof connection between the socket member which represents the pouring member and the foil bag. Leaks are thereby prevented.

It is the advantage of the embodiment of claim 11 that the bag does not collapse when emptying a container having a loose inner bag. It is thereby prevented that some of the products to be withdrawn remains in a pocket behind a collapsed portion of the bag. The container may thereby be easily emptied completely. The embodiment of claim 12 facilitates printing on the container surface and has a pleasant appearance which is sale-promoting. The embodiment of claim 12 provides for a very stiff container bottom such that the rigidity of the containers is increased and stacking is improved. The embodiment of claim 14 can ensure that the end user immediately recognizes whether he buys a product in an original package.

BRIEF DESCRIPTION OF THE DRAWINGS

Further advantages, features and objects of the invention will stand out from the following description of exemplary embodiments with reference to the drawings, wherein:

FIG. 1 is a perspective view showing part of an embodiment of the container with the ear and salient member being shortly before engaging the elongate hole;

FIG. 2 is a sectional view showing the upper part of an embodiment of the container with engaged ear and salient member;

FIG. 3 shows a particular design of the aperture according to a further embodiment of the container with engaged ear and salient member;

FIG. 4 is a front elevational view of the embodiment of FIG. 3 with the ear being folded up;

DESCRIPTION OF PREFERRED EMBODIMENTS

The container or box 1 comprises an outer carton board formed as a folded cardboard package providing stability for the container. According to a first embodiment an inner foil bag or film bag is provided in the interior of the cardboard package. According to a different embodiment the cardboard has a film-covered inside.

Figure 6:
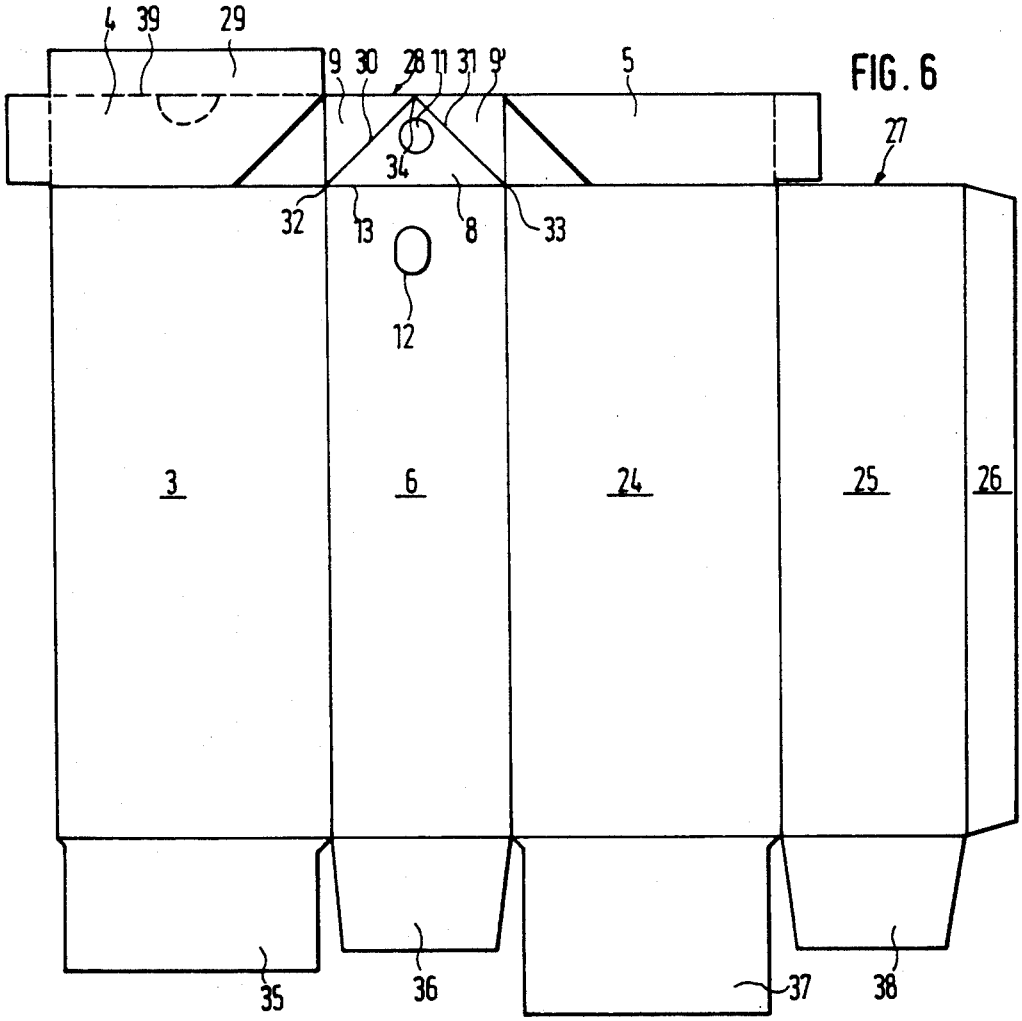
FIG. 6 showing the cut or blank for a container.

The folded cardboard package which is of parallelepiped form in the present embodiment comprises, as best shown in FIG. 6, a front wall 6, a first side wall 3 adjacent to one side of the front wall and a second side wall 24 adjacent to the opposite edge of the front wall. A back wall 25 opposite to the front wall 6 borders on the second side wall and carries an additional gluing portion or strip 26.

As shown in FIG. 6 the cut or blank has an upper edge 27 of the aforementioned walls and foldable top flaps 4 and 5 being provided at the upper edge 27 and rigidly connected with both side walls. According to a first embodiment the top flaps and a flap 28 bordering on the front wall are formed in one piece. In conventional manner the two flaps 4 and 5 are folded for closing the top side of the box and glued together at a protruding portion 29. The flap 28 comprises two folding lines 30, 31 extending from the corner points 32, 33 formed between the side wall 3 and the front wall 6 and the associated flap 4 and between the side wall 24 and the front wall 6 and the associated flap 5, resp., to the center 34 of the upper edge of flap 28. For closing the two portions 9, 9' are folded back such that they come to rest on the back side of the triangular portion 8 therebetween. The tag or ear 7 thus formed (compare in particular FIG. 1) is then folded around the folding edge 13 towards the front wall 6 in the manner indicated in FIG. 1.

Alternatively the closure of the top side may also be achieved by providing projecting portions 29 at both top flaps 4, 5 and connecting these projecting portions in the manner of a fin seam 10 (FIG. 1).

At the bottom flaps 35 to 38 are provided in conventional manner adjoining the lower edge of the walls 3, 6, 24 and 25 and the flaps 35 to 38 are folded onto each other and glued together for closing the bottom of the container.

In the embodiment shown in FIG. 6 a perforation line 39 is provided between the projection portion 29 and the top flap 4. It is the purpose of this perforation line to allow the opening of the top side by removing portion 29.

As shown in FIG. 4, the front wall 6 has a hole forming an aperture 12 provided in a predetermined distance from the edge 13. Moreover, a short tubular salient socket member 11 projecting from the plane of the triangular portion 8 is provided in the triangular portion 8 in a distance from the edge 13 corresponding to the distance of the aperture 12 from the same edge and on a straight line passing through the center of the aperture 12 and extending perpendicular to the edge 13. The arrangement is such that the member 11 enters the aperture 12 when the ear 7 is folded over in the above described manner such that the ear smoothly abuts the front wall 6.

A foil or film bag 14 receiving the product is provided within the folded cardboard package. As best shown in the FIGS. 2 and 5, the salient socket member 11 has two annular flanges 16, 17 provided at the bottom end thereof which tightly lock the foil bag 14 and the portion 8 of the flap 28 therebetween and thus provide a leak-proof connection to the interior of the foil bag 14.

The foil bag 14 within the surrounding cardboard package is closed at the bottom end thereof by a cross seal defined as a fin seam. The two ears produced thereby at the respective sides of the cross seal are clamped or sandwiched between two superposed flaps of the four bottom flaps 35 to 38 such that the foil bag is fixed to a certain degree within the cardboard package, but may be withdrawn from the cardboard package by gripping the foil bag through the opened upper opening.

This embodiment of the container is produced in the following manner. A cut or blank for the folded cardboard package with front wall 6, side walls 3, 24, a back wall 25 and associated flaps for forming a top cover and a bottom is glued together to form a sleeve-shaped box. A foil or film tube is inserted into the sleeve-shaped box. This padded or lined sleeve-shaped box is drawn over a form die.

A hole is stamped into the flap forming the bottom side of the ear 7 and into the contacting portion of the foil tube. The socket member 11 is inserted into the hole. The socket member 11 has a surrounding flange 16 provided at about half of its axial length. The socket member 11 is inserted into the hole from outside until the flange 16 abuts the ear 7. Then the portion of the socket member 11 which projects into the hollow ear 7 is bent over. Finally, the flange 16, the ear 7, the foil bag 14 and the bent-over portion are connected with each other under the influence of heat.

The top side of the foil bag is closed with a fin seam and the ears of the foil bag generated thereby are folded inwardly. The flaps of the folded cardboard package forming the top cover are folded and glued together. The cardboard ear 7 generated in this manner is folded over towards the front wall of the container. The socket member 11 is pressed into the aperture 12.

The container or foil bag 14 within the container, resp., is filled from the bottom. After the filling operation the protruding end of the foil bag 14 is expanded and sealed with a fin seam. One longitudinal flap 35 of the folded cardboard package is first folded inwardly, then two foil ears of the foil bag are bent or folded inwardly, thereafter the two dust flaps 36, 38 at the bottom of the container are placed thereabove. Thereby the foil ears are clamped between one side edge of the inner longitudinal flap 35 and the covering dust flaps 36, 38. Finally the outer bottom flap 37 is folded inwardly and glued onto the other flaps.

According to a different embodiment the foil bag is not loosely inserted into the folded cardboard package, but a fixed cardboard-foil composite is used. However, in this case the aperture 12 must be tightly covered by a vaulted or deep-drawn foil 18 in the manner shown in FIG. 3, whereby enough room must be left within the container for the socket member 11 to enter the container without pushing against the vaulted foil 18.

Owing to the cavity formed between the vaulted foil 18 and the front wall 6 of the container it is preferred that the aperture 12 is closed by one or two foldable flaps 19, 20. As shown in FIG. 4, the flaps 19, 20 are formed in the manner of a double-winged door. The door "wings" open inwardly when the socket member 11 enters the cavity formed by the vaulted foil 18. The wings close again when the socket member is removed from the aperture for use.

Figure 5:
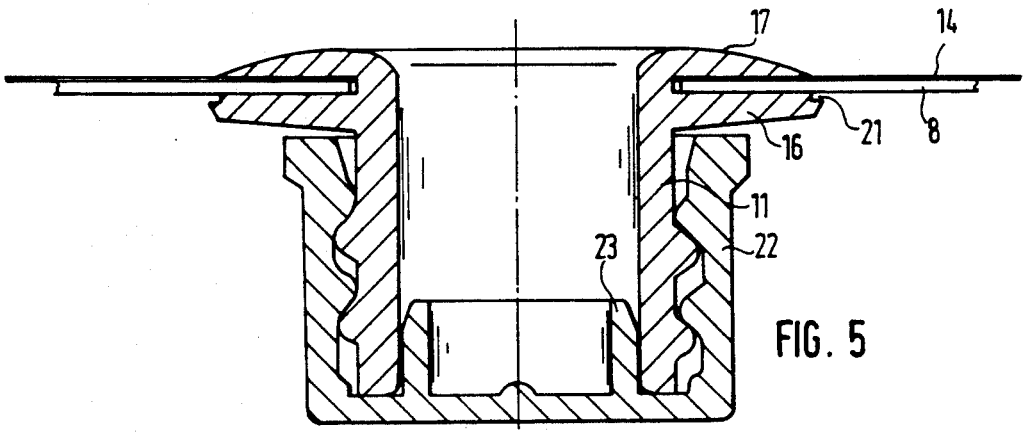
FIG. 5 being a cross-sectional view of an embodiment of the salient member.

According to a further preferred embodiment the flange 16 of the socket member 11 comprises a recess 21 shown in FIG. 5. When the socket member 11 is pressed into the aperture 12, it can be pressed thereinto to such an extent that the recess 21 latches behind the cutting edges of the aperture 12, whereby the ear 7 is locked in its position parallel to the front wall 6.

The latching or locking of the recess 21 within aperture 12 is facilitated by forming aperture 12 as an elongate hole, as shown in FIG. 4. The longitudinal axis of the hole coincides with the connecting line of hole center and the center of socket member 11. In this case the recess 21 can safely latch behind the longitudinal cutting edge of the elongate hole. Moreover, the form of an elongate hole is advantageous by providing clearance in a vertical direction when inserting the socket member 11 into the aperture. This facilitates the introduction of the socket member 11 into the hole formed by aperture 12.

According to a further embodiment a closure member 22 is provided for the socket member 11. Preferably the closure member is screwed onto the socket member 11, but it may also be slipped thereon and held by friction fit. It is also possible to close the socket member 11 by means of a thin membrane during manufacture such that emergence of the product within the container even during extensive transport is securely prevented. If this membrane is thin enough, the user may simply pierce the same and remove the product. In this case a simple closure member 22 may be provided for closing the container by the end user. According to a further embodiment a self-closing lip is provided at the end of the socket member 11 such that the membrane may be dispensed with. Additionally an inner cone 23 may be provided on the closure member 22 as shown in FIG. 5. This inner cone securely seals the hole within the socket member 11.

According to a further embodiment a label is fastened to the ear 7 extending parallel to the front wall 6 of the container after finishing, filling and closing the container (as shown in FIG. 2). The label may also partly cover the front wall 6. If this label is intact, the end user can be certain that the package is an original package which has not yet been opened.

For use the end user removes the label. Then the user unlocks and folds upwardly the ear 7. By finger pressure onto the corner areas of the container the narrow sides and ear surfaces bend or curve such that the closure can most suitably be opened. The product may be poured or emptied out of the container in the same manner as with a port or watering can.

Reclosure is obtained by folding back the ear 7 until the recess 21 is locked or latched in the front wall 6.

The empty container can be opened with few operations along the perforation line provided in the top cover. A good access to the empty foil bag is obtained thereby and the foil bag is freed from the fixation of its bottom ears and drawn outwardly. It only remains to remove the clamping connection around the socket member by tearingly freeing the folded cardboard package from the empty bag with support by the favorable lever arm.

A consistent disposal is then possible by putting the empty bag into a collecting container for plastic material; a disposal of the remaining pure cardboard package is also possible without problems.

While the invention has been described in preferred form, it is not limited to the precise nature shown, as various modifications may be made without departing from the scope of the appended claims.

What is claimed is:

1. Container for packaging liquids, comprising side walls, a bottom flap, a top flap, an ear to be folded down around a folding edge, a socket member projecting from said ear for forming a pouring spout at the surface of said ear which, when folded down, abuts one of the side walls, one of said side walls having an aperture for receiving said socket member.

2. A container as recited in claim 1, further comprising a closure member formed to be screwed or slipped on to said socket member.

3. A container as recited in claim 1, wherein said socket member is closed by a pierceable membrane or comprises a self-closing lip.

4. A container as recited in claim 1, wherein said socket member comprises a flange which abuts the surface of said ear and which is tightly connected therewith.

5. A container as recited in claim 1, wherein said container is formed from a rigid cardboard-foil composite.

6. A container as recited in claim 5, wherein said aperture is inwardly sealed by a curved or vaulted foil fastened to the inner side of the container wall.

7. A container as recited in claim 1, wherein said aperture is formed by an elongate hole and wherein said socket member is formed to lock or latch behind the cutting edges of said elongate hole when inserting said socket member.

8. A container as recited in claim 1, further comprising an openable flap outwardly sealing said aperture.

9. A container as recited in claim 1, wherein said container is formed from a stiff outer folded cardboard package and a leak-proof loose inner foil bag.

10. A container as recited in claim 9, wherein said socket member is formed of plastic and wherein a portion of said socket member which extends into the interior of said ear also extends into the interior of said inner foil bag and is welded thereto.

11. A container as recited in claim 9, wherein said folded cardboard package comprises two overlapping folding flaps at the bottom thereof for closing said bottom and whereby at least one ear of said foil bag is clamped between said two flaps of said folded cardboard package.

12. A container as recited in claim 9, wherein a bottom flap is provided for each side wall and wherein a plurality of ears of said inner foil bag are clamped or held between the bottom flaps of the folded cardboard package.

13. A container as recited in claim 1, wherein said folded-down ear is covered by a label after filling said container.

* * * * *